United States Patent [19]

Smirnoff

[11] Patent Number: 4,828,767

[45] Date of Patent: May 9, 1989

[54] METHOD AND SYSTEM FOR INSTALLING STEAM DESUPERHEATERS

[75] Inventor: Richard M. Smirnoff, San Pedro, Calif.

[73] Assignee: Atlantic Richfield Company, Los Angeles, Calif.

[21] Appl. No.: 239,479

[22] Filed: Sep. 1, 1988

[51] Int. Cl.[4] ..... B01F 3/04

[52] U.S. Cl. ..... 261/71; 261/DIG. 13; 137/318

[58] Field of Search ..... 261/DIG. 13, 71; 137/318

[56] References Cited

U.S. PATENT DOCUMENTS

| | | | |
|---|---|---|---|
| 3,272,033 | 9/1966 | Leopold, Jr. et al. | 137/318 |
| 3,331,590 | 7/1967 | Battenfeld et al. | 261/DIG. 13 |
| 3,719,524 | 3/1973 | Ripley et al. | 261/DIG. 13 |
| 4,345,613 | 8/1982 | Mills et al. | 137/318 |
| 4,442,047 | 4/1984 | Johnson | 261/DIG. 13 |
| 4,492,095 | 1/1985 | Brister | 137/13 |

*Primary Examiner*—Tim Miles

*Attorney, Agent, or Firm*—Michael E. Martin

[57] ABSTRACT

Steam distribution lines may be adapted for desuperheat without being removed from service by adding a branch conduit and a closure valve, hot tapping the line through the closure valve and adding a desuperheater apparatus including an elongated injection conduit with water injection nozzles disposed near the distal end thereof. An insertion and retraction device is mounted on the valve and supports the desuperheater apparatus for insertion of the desuperheat water injection conduit into the interior of the distribution line without interrupting steam flow. Temperature indicators and controllers are similarly installed on the distribution line downstream of the desuperheater apparatus.

3 Claims, 3 Drawing Sheets

METHOD AND SYSTEM FOR INSTALLING STEAM DESUPERHEATERS

BACKGROUND OF THE INVENTION

1. Field of the Invention

The present invention pertains to a desuperheater apparatus installed in a steam carrying pipeline through a valve connected to the pipeline and an insertion and retraction device whereby the desuperheater may be installed without taking the line out of service.

2. Background

In many steam distribution systems, such as are found in petroleum refineries and the like, it is essential to maintain operations and to avoid interrupting the supply of steam through the system. On the other hand, from time to time, there are requirements to change the thermal conditions of the steam such as by adding or deleting desuperheating water to the steam supply network at selected points.

The present invention is directed to a method and apparatus for installing desuperheating capabilities in steam distribution piping, particularly in applications wherein the distribution lines cannot be shut down or isolated for installation of desuperheaters in a conventional manner.

SUMMARY OF THE INVENTION

The present invention provides an improved method for installing a desuperheater in a steam distribution pipeline and the like without interrupting steam flow through the pipeline during the installation process.

In accordance with one aspect of the present invention a steam distribution pipeline is modified to include a branch fitting and a valve supported on the fitting together with an insertion device which is adapted to support a desuperheater apparatus having an elongated conduit with desuperheater water injection nozzles formed therein. The insertion device is mounted on the valve and the desuperheater device is mounted in such a way as to be inserted into the interior of the distribution line through the valve in a selected working position and a retracted position. A desuperheater water conduit is connected to the desuperheater and the desuperheater is operated in accordance with suitable temperature controls which are also installed in the steam distribution line without interrupting steam flow therethrough at spaced apart points downstream of the desuperheater installation.

In accordance with yet another aspect of the present invention, an apparatus is provided comprising a retractable desuperheater assembly for installation in a steam distribution pipeline or the like wherein the desuperheater apparatus may be installed in a working position without interrupting the flow of steam through the line and the desuperheater may be retracted to a position clear of the pipe interior.

Those skilled in the art will recognize the above described features and advantages of the present invention as well as other superior aspects thereof upon reading the detailed description which follows in conjunction with the drawing.

DESCRIPTION OF A PREFERRED EMBODIMENT

Figure 1:
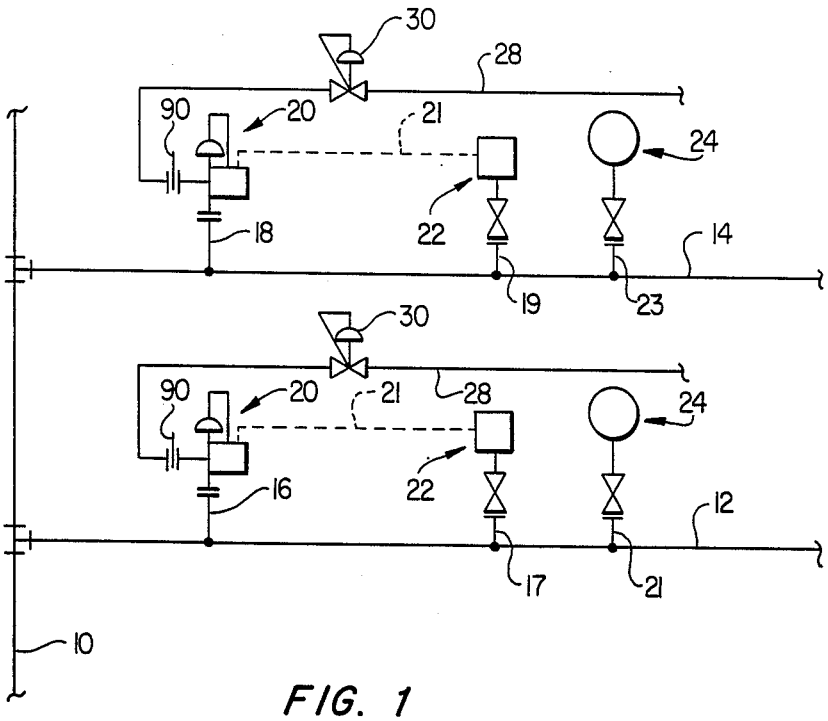
FIG. 1 is a schematic diagram of a steam distribution system showing the components of respective desuperheater systems installed in separate steam distribution lines.

In the description which follows like parts are marked throughout the specification and drawing with the same reference numerals, respectively. The drawing figures are not necessarily to scale and certain features of the invention may be shown in schematic form or described in general terms only when such elements are conventional or otherwise commercially available, all in the interest of clarity and concisenes.

Referring to FIG. 1, there is illustrated a portion of a high pressure steam distribution system including a steam header pipe 10 to which are connected individual steam distribution lines or conduits 12 and 14, respectively. From time to time in complex steam distribution systems it is desirable to change the characteristics of steam flowing through respective distribution lines and to avoid taking those lines out of service under virtually any circumstance. In accordance with the present invention an improved method and system have been developed for installing desuperheaters in respective steam distribution lines together with automatic controls for operating said desuperheaters. As indicated schematically in FIG. 1 respective branch conduit portions 16 and 18 have been installed on the respective steam distribution lines 12 and 14 and respective desuperheater units 20 have been installed for injecting steam desuperheating water into the steam flow of the respective distribution lines 12 and 14 in accordance with the present invention.

The installation of the steam desuperheater units 20 includes also the installation of respective temperature indicator and controller units 22 for each of the desuperheater units which include temperature sensors adapted to be inserted into a suitable steam temperature sensing position within each of the distribution lines by way of branch conduits 17 and 19, respectively. The controllers 22 are connected to the apparatuses 20 by suitable signal conductors 21, respectively. Second temperature indicators and/or controllers 24 are also suitably installed in each of the steam distribution lines through respective conduits 21 and 23 so that confirmation of the temperature of the desuperheated steam may be monitored when such is required. Each of the desuperheaters 20 is provided with desuperheating water by way of a conduit 28 and a suitable pressure regulator valve 30.

Figure 2:
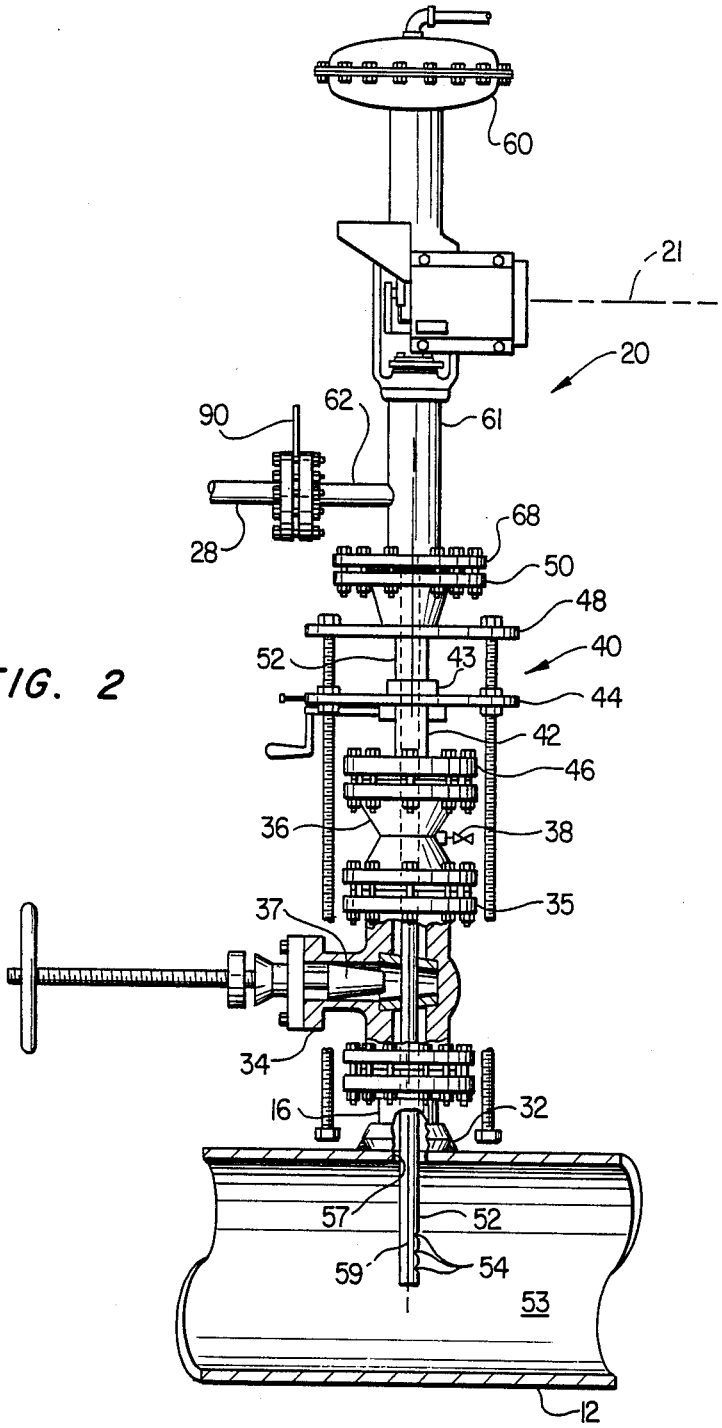
FIG. 2 is an elevation, partially sectioned, of one of the desuperheater installations in accordance with the present invention.

Referring now to FIG. 2, the desuperheater units 20 may be installed in each of the steam distribution lines 12 and 14 as shown by way of example for the distribution line 12 without removing the distribution lines from service or otherwise interrupting the flow of steam therethrough. The branch conduit 16 comprises a flanged fitting which is suitably welded to the distribution line 12 at a peripheral weld 32. A conventional flanged gate valve or the like 34 is installed on the branch fitting 16 and a second fitting 36 in the form of a pair of opposed weldneck flanges is secured to a flange 35 of the valve 34. Preferably, the fitting 36 has a fluid bleed fitting 38 included therein for bleeding pressure fluid from the interior passage formed by the opposed weld neck flanges. A modified insertion and retraction mechanism, generally designated by the numeral 40, is supported on the fitting 36. The mechanism 40 may be of a type commercially available such as from Dieterich Standard, Division of Dover Industries, Boulder, Colo. as their type IHD insertion and retraction mechanism. This mechanism includes a tubular packing gland 42 connected to a transverse plate member 44 and also secured to a flange 46 which is bolted to the fitting 36. A second support plate 48 is provided as part of the mechanism 40 which supports a weldneck flange 50 in alignment with the packing gland 42.

The desuperheater apparatus 20 is of a type commercially available such as manufactured by Yarway Corporation, Blue Bell, Pennsylvania under the trademark TempLow. The desuperheater apparatus 20 includes an elongated tubular conduit member 52 which is extendable into the interior space 53 of the distribution line 12 and includes a plurality of water jet nozzles 54 formed adjacent the distal end thereof. The conduit 52 extends through the branch fitting 16, the valve 34, the fitting 36 and the packing gland 42 and is connected to an actuator mechanism, generally designated by the numeral 60. Desuperheater water is admitted to the interior of the actuator mechanism 60 by way of a branch conduit 62 and is controlled to flow to the nozzles 54 in selected amounts by the actuator 60. The actuator 60 includes a housing portion 61 which is secured to a flange 68 for supporting the desuperheater apparatus 20 on the retraction mechanism 40. In the illustration of FIG. 2, the desuperheater conduit 52 is extended fully into the interior of the distribution line 12 but may be retracted completely from the distribution line and upward, viewing FIG. 2, past the closure member 37 of the valve 34 so that the closure member may be closed to prevent escape of steam from the distribution line 12 when performing maintenance or demounting of the mechanism 40 or the desuperheater apparatus 20 from the branch conduit 16. The retraction mechanism 40 is of a type wherein the plate 48 is adapted to be moved with respect to the plate 44 in an axial direction along the axis 59, FIG. 2, to provide for inserting or withdrawing the desuperheater conduit 52 with respect to the interior of the distribution line 12.

Figure 3:
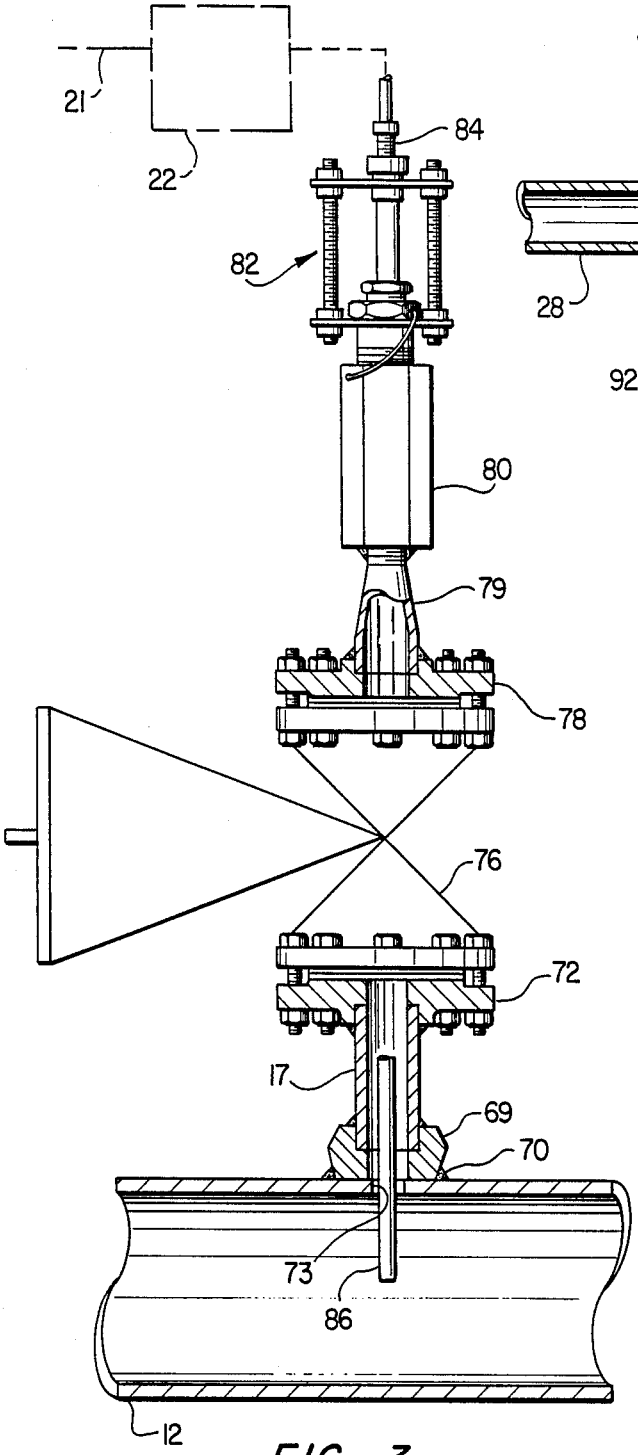
FIG. 3 is an elevation, partially sectioned, of one of the desuperheater temperature controller installations in accordance with the present invention.

Referring now to FIG. 3, the temperature controller 22 is adapted to be supported on the branch conduit 17 in a similar manner to that described for support of the desuperheater 20. The conduit 17 includes a flange 69 which is suitably welded to the distribution line 12 at 70 and a flange 72 for connecting the conduit to a suitable gate valve 76. The gate valve 76 is shown in schematic form and is secured to a flange 78 comprising part of a conduit 79. The conduit 79 is connected to a suitable pressure fitting 80 of a type commercially available such as made by COSASCO Div. of Grant Oil Tool Co., Los Angeles, CA. The fitting 80 is similar to a packing gland and is adapted to support an insertion and retraction device 82 which, in turn, supports a probe 84 for the controller 22. The probe 84 is adapted to include an elongated tubular sensing member 86 extendable into the interior of the distribution conduit 12, as illustrated. In like manner, the temperature indicator 24 is similarly installed on the branch conduit 21 utilizing a fitting 80 and insertion device 82.

Preparation of the steam distribution lines 12 and 14 for distributing desuperheated steam is carried out by first installing the branch fittings 16, 17 and 21, for example, on distribution line 12 using conventional welding practices. After installing the branch fittings, the valves 34 and 76 are suitably installed on the branch fittings, respectively. At this point a suitable tapping machine such as of the type described in U.S. Pat. No. 4,492,095 to Brister is installed on the valve 34, for example, the valve closure member 37 is moved to an open position, and a suitable opening 57, FIG. 2, is formed in the distribution line using conventional practices. After forming the opening 57 the tapping machine is withdrawn, the valve 34 is closed and the tapping machine removed from the valve flange 35.

At this time the insertion and retraction mechanism 40 is installed on the valve flange 35 together with installation of the desuperheater apparatus 20 on the mechanism 40. The conduit 52 is already inserted into the packing gland 42 and in suitable pressure sealed relationship with the gland by way of conventional packing and a packing retainer or nut 43, FIG. 2. Upon installation of the insertion and retraction mechanism 40 and the desuperheater apparatus 20 on the valve 34, the valve is opened and the conduit 52 extended into and through the valve body, and the opening 57 into the position shown in the conduit interior space 53.

Figure 4:
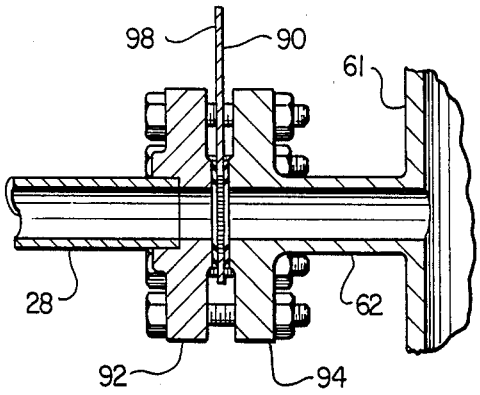
FIG. 4 is a detail section view of a desuperheater water strainer.

At this time the desuperheater water conduit 28 may be connected to the branch conduit 62 and a strainer or filter plate 90, FIG. 4, is interposed between conduit flanges 92 and 94.

Figure 5:
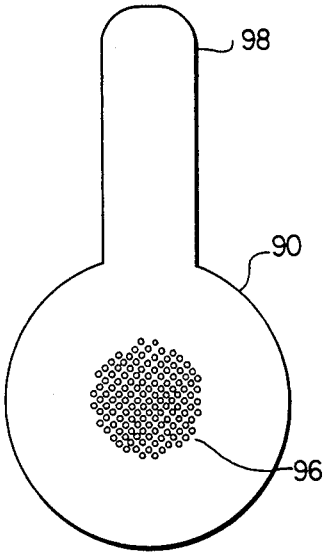
FIG. 5 is a plan view of a strainer element.

Referring to FIG. 4 and FIG. 5, there is illustrated some detail of the strainer 90 which comprises a flat plate having a foraminous area 96 formed by a plurality of perforations and an identifier tab 98. The flanges 92 and 94 are suitably bolted together with the strainer plate 90 interposed there between to minimize the chance of clogging the desuperheater flow nozzles 54 by contaminants in the desuperheater water line 28. After connection of the desuperheater water line 28 to the apparatus 20 the desuperheater is ready for operation pending installation of its controller 22.

Installation of the controller mechanisms 22 and the indicators 24 is carried out in a manner similar to the installation of the desuperheater within the conduit 12, that is, a suitable opening 73, FIG. 3, is formed in the distribution conduit 12 after installing the valve 76, using a tapping machine as previously described. Upon removal of the tapping machine from the valve 76 the fitting 80 and insertion and retraction device 82 are installed together with the probe 84 which is then forcibly inserted into the interior space 53 of the distribution line 12. The temperature indicator 24 is similarly installed. After connection of the desuperheater control line between the controller 22 and the apparatus 20 and connection of the conduit 28 the desuperheater system is ready for operation without any interruption of steam service through the conduit 12. Of course, the distribution line 14 is similarly adapted for desuperheating its steam flow upon installation of an associated apparatus 20, controller 22 and indicator 24.

The best mode of practicing the present invention is believed to be adequately described herein. Conventional engineering materials and commercially available components can be utilized in practicing the invention as described and specified hereinabove. Although a preferred embodiment of the invention has been described in detail herein, those skilled in the art will recognize that various substitutions and modifications may be made to the invention without departing from the scope and spirit thereof as recited in the appended claims.

What is claimed is:

1. A method for providing desuperheated steam in a steam conduit without interrupting the flow of steam through said steam conduit comprising the steps of:

securing a branch conduit at a selected point on said steam conduit, said branch conduit including valve means disposed thereon and having a closure member moveable between an open and closed position;

forming an opening in the sidewall of said steam conduit to permit the insertion of a desuperheater water conduit into the interior of said steam conduit through said valve and said branch conduit;

mounting a desuperheater apparatus on said valve means having an elongated desuperheater water conduit formed thereon, said desuperheater apparatus being supported by an insertion and retraction device for moving said desuperheater water conduit through said valve means and said branch conduit into the interior of said steam conduit;

operating said device to insert said desuperheater water conduit into the interior of said steam conduit;

connecting said desuperheater apparatus to a source of desuperheater water; and injecting desuperheater water through said desuperheater water conduit into the interior of said steam conduit without interrupting the flow of steam through said steam conduit.

2. The method set forth in claim 1 including the steps of:

installing a branch conduit on said steam conduit at a point downstream in the direction of flow of steam through said steam conduit from said desuperheater apparatus;

installing a valve on said branch fitting including a closure member moveable between open and closed positions;

tapping an opening into said steam conduit through said valve and installing a temperature controller including temperature sensing means in the interior of said steam conduit; and connecting said controller to said desuperheater apparatus for automatically controlling the injection of desuperheater water into said steam conduit to control the temperature of steam flowing through said steam conduit.

3. For use in desuperheating steam flowing through a steam distribution conduit without interrupting the flow of steam through said distribution conduit, wherein said distribution conduit has a branch conduit fitting formed thereon and a closure valve connected to said branch conduit fitting and including a closure member moveable between open and closed positions, the combination comprising:

a desuperheater apparatus including an elongated desuperheater water injection conduit having a distal end insertable through said valve into the interior of said distribution conduit, said injection conduit including at least one water injection opening formed thereon;

an insertion and retraction mechanism including means for supporting said desuperheater apparatus and a packing gland for forming a fluid tight seal around said injection conduit; and means for supporting said mechanism on said valve whereby said closure member may be moved to an open position and said injection conduit may be inserted into or retracted from the interior of said distribution conduit for adding desuperheat water to said distribution conduit without removing said distribution conduit from steam supply service.

* * * * *